US006672243B2

(12) United States Patent
Seymour et al.

(10) Patent No.: US 6,672,243 B2
(45) Date of Patent: Jan. 6, 2004

(54) DISPLAY DEVICE

(76) Inventors: Michael Seymour, 25 Newman Street, London W1P 3HA (GB); Ronald Hugh Illingworth, 25 Newman Street, London W1P 3HA (GB); Karen Ann Lewis, 25 Newman Street, London W1P 3HA (GB)

( * ) Notice: Subject to any disclaimer, the term of this patent is extended or adjusted under 35 U.S.C. 154(b) by 0 days.

(21) Appl. No.: 10/038,372

(22) Filed: Nov. 9, 2001

(65) Prior Publication Data

US 2002/0178993 A1 Dec. 5, 2002

Related U.S. Application Data

(63) Continuation-in-part of application No. 09/269,582, filed on Sep. 21, 1999, now abandoned.

(30) Foreign Application Priority Data

Sep. 25, 1996 (GB) ..... 9619977

(51) Int. Cl.[7] ..... G09F 17/00
(52) U.S. Cl. ..... 116/28 R; 116/173; 40/591
(58) Field of Search ..... 116/28 R, 30, 116/35 R, 37, 42, 43, 56, 173, 174; 40/591, 592, 212, 214, 215, 602; D10/59; 73/170.01, 170.02, 170.05, 170.07, 170.11; 446/34, 167, 177, 180; 244/153 R, 153 A, 145

(56) References Cited

U.S. PATENT DOCUMENTS

| | | | | | |
|---|---|---|---|---|---|
| 1,794,018 | A | * | 2/1931 | Homan | 40/592 |
| 2,090,121 | A | * | 8/1937 | Hayes | 116/173 |
| 2,216,776 | A | * | 10/1940 | Hoffman | 273/360 |
| 2,238,876 | A | * | 4/1941 | Manson | 273/360 |
| 2,478,273 | A | * | 8/1949 | Jenkins | 343/899 |
| 3,495,568 | A | * | 2/1970 | Palinkos | 116/173 |
| 4,558,862 | A | * | 12/1985 | Kelly | 473/176 |
| 4,730,488 | A | * | 3/1988 | David | 73/170.07 |
| 4,901,662 | A | * | 2/1990 | Sandeen et al. | 116/28 R |
| 4,964,360 | A | * | 10/1990 | Henry | 116/28 R |
| 4,989,356 | A | * | 2/1991 | Combs | 40/584 |
| 5,172,506 | A | * | 12/1992 | Tiley et al. | 43/3 |
| 5,186,675 | A | * | 2/1993 | D. Stoddard | 446/199 |
| 5,299,525 | A | * | 4/1994 | Romesburg | 116/173 |
| 5,319,967 | A | * | 6/1994 | Rickards, Jr. | 73/170.06 |
| 5,320,061 | A | * | 6/1994 | Laughlin et al. | 116/28 R |
| 5,365,685 | A | * | 11/1994 | Shank | 40/212 |
| 5,517,941 | A | * | 5/1996 | Fisher | 116/173 |
| 5,540,181 | A | * | 7/1996 | Pearce | 116/173 |
| 5,810,294 | A | * | 9/1998 | Knight et al. | 244/153 A |
| 5,810,637 | A | * | 9/1998 | Mileti | 446/61 |
| 5,833,174 | A | * | 11/1998 | Knight et al. | 244/155 A |
| 6,032,523 | A | * | 3/2000 | Smith | 73/170.07 |
| D426,782 | S | * | 6/2000 | Nodes | D10/59 |
| 6,279,254 | B1 | * | 8/2001 | Gill et al. | 40/439 |

FOREIGN PATENT DOCUMENTS

| | | | | |
|---|---|---|---|---|
| GB | 2037467 | * | 7/1980 | G08B/5/00 |
| GB | 2237674 | * | 5/1991 | G09F/17/00 |

* cited by examiner

*Primary Examiner*—Diego Gutierrez
*Assistant Examiner*—R. Alexander Smith
(74) *Attorney, Agent, or Firm*—Galgano & Burke

(57) ABSTRACT

A display device for use on a moving vehicle, said display device comprising:

(i) a flexible, inflatable tube with a mouth and a tail end, said tube being adapted such that air currents can flow through the tube and in doing so cause the tube to inflate;

(ii) a reinforced collar region around the mouth of the tube;

(iii) a first attachment means being an integral part of or adapted to attach to a vehicle;

(iv) a second attachment means adapted to attach the collar region of tube to the first attachment means on the motor vehicle;

and wherein the sides of the tube are adapted to display advertising or other display material.

12 Claims, 13 Drawing Sheets

Fig.36
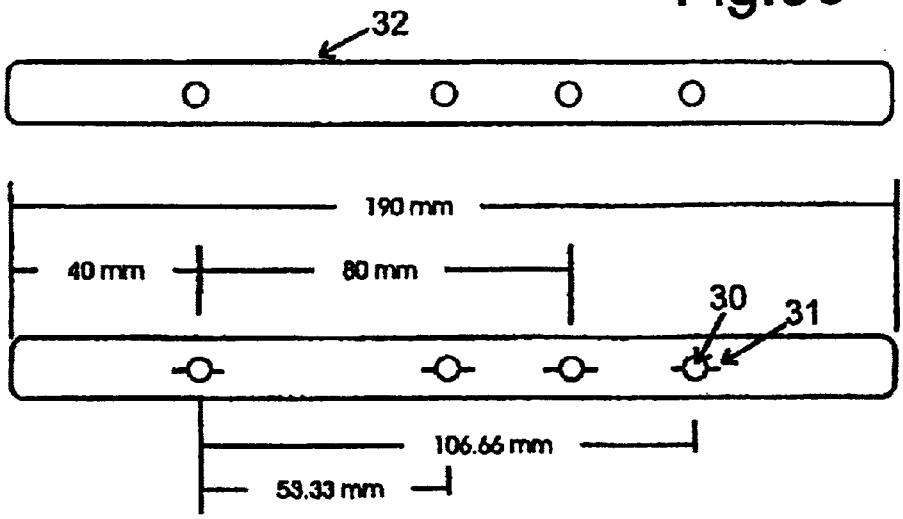
Fig.37
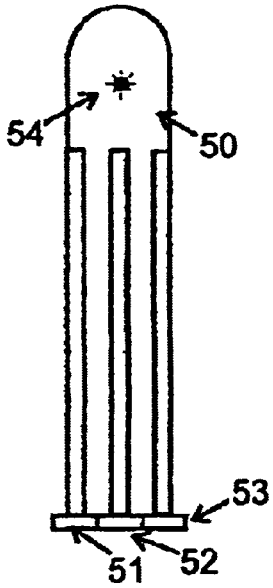
Fig.38
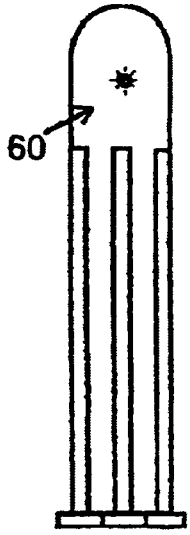
Fig.39
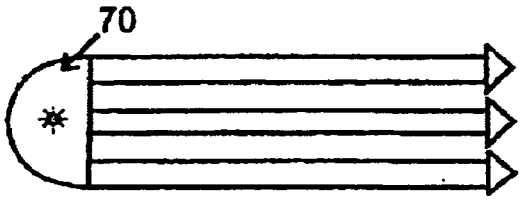
Fig.40

DISPLAY DEVICE

This application is a continuation in part of application Ser. No. 09/269,582 filed Sept. 21, 1999, now abandoned.

FIELD OF INVENTION

This invention relates to a display device particularly for use on vehicles.

BACKGROUND TO THE INVENTION

Several types of display device for use on vehicles are known and some of these act in a way similar to a windsock. If it is desired to provide a surface for the display of information on the side of a windsock several problems are encountered.

For example, windsocks typically used on airfields for indicating wind direction consist of a fabric bag, with the shape of a cone. The fabric bag is open at both ends and is erected on a tall pole with the wider end of the cone nearest the pole. The wider mouth of the cone is provided with a support so that this mouth always remains open and does not close up as the fabric sides of the cone fall together. This support may be provided by a rigid structure placed around the wider mouth of the cone. This support also forms the mounting point by which the windsock is attached to a pole.

In this way air is always free to flow through the cone so that the pressure from the wind distends the fabric sides of the cone. The cone is free to rotate about the pole so that the wind direction is indicated by the position of the cone about the pole.

One problem with these kinds of windsock is that when the sock is deflated the fabric tends to hang down creating a crease near the support. The fabric is put under greater strain at this point and tends to rip or tear.

A further problem is that if no support is provided around the mouth of the cone the sides of the cone fall together. This means that air currents can simply make the fabric twist and turn about rather than entering the cone and distending the fabric sides to give the cone an inflated structure. In this way any information that is displayed on the side of the windsock is not always visible or presented on a clear and even surface.

Known windsocks are also problematic in that they must be constructed from hardwearing anti-rip fabric. This is necessary to prevent the wind sock from breaking up under the forces of the wind. The windsock must also be weather proof and able to withstand the elements. These types of windsock are therefore expensive to manufacture and costly to replace if it is desired to use them to display advertising material and the like, which is often changed.

Another problem with known windsocks is that instability is often produced with turbulent air currents. That is, the windsock tends to twist and turn about and be pulled in different directions. This increases the risk of the fabric tearing and becoming worm. Also the windsock is prevented from forming into its cone structure and may become tangled up in itself. This may mean that it is necessary to untwist the cone and remount the whole windsock. This is not only time consuming but means that the windsock is out of action for some periods.

Windsocks, similar to those used on airfields, are also known for use on yachts and other moving vehicles both to indicate wind direction and to provide decoration. For example, wind socks made from coloured fabric are known which have strips of fabric at the end of the cone to act as streamers. This type of windsock has similar disadvantages as those used on airfields. For example they must be made from expensive anti-rip fabrics and they become unstable during turbulent airflows. However, these problems are particularly accentuated when it is desired to use the windsock on a moving vehicle. This type of windsock must be able to withstand very high wind speeds together with turbulent airflows created by the motion of the vehicle. The support structure around the mouth of the cone is relatively heavy and has its own inherent drag. This presents problems when it comes to mounting it on a vehicle. Known windsocks have used expensive anti-rip fabrics in order to cope with these conditions. The problems of instability are also increased because of the frequent turbulent airflows. Another problem involves the means by which the windsock is attached to the vehicle and how the mouth of the cone can be held open. If the mouth of the cone is held open by using a rigid support this is likely to break under the forces of the wind. One further problem with the known wind socks is that they have typically been attached to the vehicle using means which is not adequate to both prevent the wind sock from coming off and to prevent the wind sock from becoming unstable and twisting and turning about.

Another problem with the use of windsocks on vehicles is that it may be desired to position the windsock on a retractable pole, aerial or similar structure. However, known windsocks are not suitable for use on retractable poles, aerials or the like.

One disadvantage with known windsocks is that it is difficult to display a message or coloured image as a form of communication on the windsock. Known windsocks do not have a flight pattern that is sufficiently stable or have an ability to inflate sufficiently readily to allow such messages to be read.

Known windsocks are designed to be inflated by the wind and so to depict the wind condition. They require the natural element of the wind to be present for inflation. Known windsocks are problematic in that they are unable to inflate when no wind is present and are not designed to inflate using air currents created by the motion of a vehicle.

It is accordingly an object of the present invention to provide a display device particularly suitable for use on moving vehicles which overcomes or at least mitigates one or more of the problems noted above.

SUMMARY OF THE INVENTION

According to the present invention there is provided a vehicle of the type having an upstanding aerial or pseudo aerial, the improvement comprising a display device, said display device comprising:

(i) a flexible, inflatable tube with a mouth end and a tail end, said mouth end being movable between a normally flat collapsed state and a substantially open inflated state;

(ii) a reinforced flexible collar region extending around substantially the whole circumference of the mouth end of the tube, the collar region being adapted such that mouth end of the tube tends to adopt a flat collapsed state, the mouth end incorporating at least one fixing hole in the reinforced flexible collar region; and (iii) means to attach the reinforced collar region of the inflatable tube to a vehicle aerial or pseudo aerial.

Preferably the reinforced flexible collar region is formed from a strip of plastics materials fixed around the mouth end of the tube.

Preferably the reinforced collar region comprises a region of the tube of increased material thickness compare to the main body of the tube.

Preferably the reinforced collar region comprises a tubular channel extending substantially around the circumference of the mouth end of the tube said channel incorporating a reinforcing strip.

Preferably the reinforced flexible collar region incorporates two fixing holes, diametrically opposed one to the other.

Preferably the vehicle mounting means comprises a cross-member and a fixing bar, the ends of the cross member being adapted to engage with the reinforced collar region of the inflatable tube, and the fixing bar being adapted to attach to a vehicle aerial or pseudo aerial.

Preferably the means to attach the collar region of the tube to a vehicle aerial or pseudo aerial is formed from a pliable resilient plastics material.

Preferably the means to attach the collar region of the tube to the vehicle aerial or pseudo aerial comprises a substantially T-shaped assembly formed from a cross member and a fixing bar, the cross member incorporating a lug at each end of the cross member, said lugs being adapted to pass through respective holes in the reinforced flexible collar, said cross member further incorporating a stop, adjacent each lug, said stops being located inwardly of the lugs to prevent the sides of the tube passing along the cross member, and resisting the natural tendency of the tube to adopt a flat collapsed state.

Preferably the flexible tube is frusto-conical in shape, having an opening at each end.

Preferably the flexible tube is frusto-conical in shape having an aspect ratio of the diameter of the large opening to the diameter of the small opening in the range 1.05 to 2.4.

Preferably the flexible tube is frusto-conical in shape having an aspect ratio of the diameter of the large opening to the diameter of the small opening in the range 1.4±0.3.

Preferably the flexible tube is frusto-conical in shape having a ratio of the length of the tube to the diameter of the large opening to the diameter of small opening of the 210±40 to 50±10 to 35±5.

Preferably the flexible tube is frusto-conical in shape having a ratio of the length of the tube to the diameter of the large opening to the diameter of the small opening of 210±10 to 50±5 to 35±4.

The invention also includes an assembly comprising:

a vehicle;

an aerial or pseudo aerial mounted on said vehicle; and a display device as set out above and as herein described.

According to a further aspect of the present invention there is provided a windsock display device for use on a moving vehicle, said display device comprising:

(i) a flexible, inflatable tube with a mouth end and a tail end;

(ii) a reinforced flexible collar region around the mouth of the tube;

(iii) a first attachment means being an integral part of or adapted to attach to a vehicle; and (iv) a second attachment means adapted to attach the collar region of tube to the first attachment means on the motor vehicle;

characterised in that with the display device in its assembled state the collar region remains substantially flexible, such that when the vehicle is stationary the collar region tends to collapse and when the vehicle is in motion the collar region is held substantially open.

This provides a simple, inexpensive device for the display of advertising material in an eye-catching manner.

Preferably, the first attachment means comprises a vehicle aerial. Most cars have radio aerials and they are a convenient fixing point.

In an alternative embodiment the first attachment means comprises a mounting element adapted to be secured to a vehicle in the form of a pseudo aerial, said mounting element being further adapted to incorporate a mounting post. This feature enables the device to be attached to vehicles without aerials.

Preferably, the second attachment means comprises one or more holes in the collar region of the tube.

In an alternative embodiment the second attachment means comprises a fixing means adapted to connect the first attachment means to the reinforced collar region of tube.

Preferably the fixing means comprises an elastic strap.

In a particularly preferred embodiment the fixing means comprises a three-pronged connector, the end of each prong being adapted to engage in a hole in the reinforced collar and the region of the collar furthest from the end of each prong being adapted to attach to the first attachment means.

Preferably the reinforced collar region is formed from a strip of plastics material fixed around the mouth of the tube such that in use when the vehicle is stationary the collar region of the tube is substantially collapsed and when the vehicle is in motion the mouth of the tube is held substantially open and the display device is deployed to provide a surface for display of advertising material and the like. When the vehicle starts to move, the mouth of the tube is held open and air currents enter the tube and inflate the tube. Problems of instability are reduced; that is the tube is deployed in a stable position and does not tend to twist and turn about despite the presence of turbulent air currents that may be created by the motion of the vehicle.

Preferably the reinforced collar region comprises a tubular channel extending substantially around the circumference of the mouth of the tube, said channel incorporating a reinforcing strip.

Alternatively the reinforced collar region comprises a region of increased material thickness compared to the main body of the tube.

DESCRIPTION OF THE DRAWINGS

The invention will be further described, by way of example, with reference to the accompanying drawings in which:

FIGS. 36 and 37 illustrate a strap used to create a reinforced region around the mouth of the tube;

FIGS. 38 to 40 inclusive show various three-pronged mounting strips;

DESCRIPTION OF PREFERRED EMBODIMENTS

Embodiments of the present invention are described below by way of example only. These examples represent the best ways of putting the invention into practice that are currently known to the Applicant although they are not the only ways in which this could be achieved.

The display device is adapted for use on a vehicle where the term vehicle has a broad meaning any type of vehicle capable of movement including, for example, cars, boats, ships, bicycles, commercial vehicles and motor cycles and the like.

Figure 1:
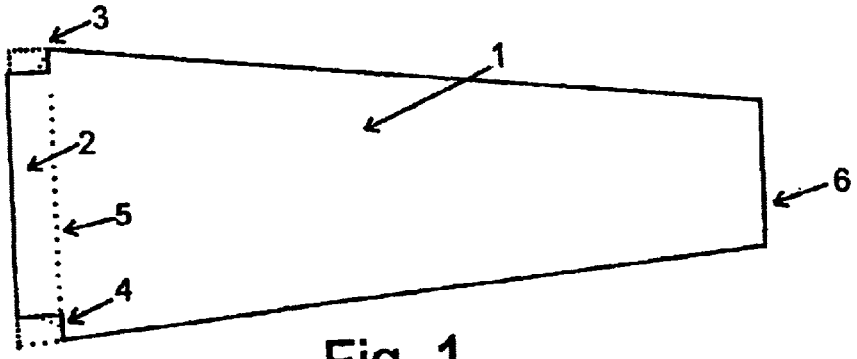
FIG. 1 shows a side view of a display device tube.

As shown in FIG. 1, an embodiment of the display device includes a tube 1 which is formed into a conical shape although many other shapes could be used, for example, a tube with parallel sides or a bottle shaped form (see below). The tube 1 is manufactured from a flexible, lightweight material such as fabric, plastics material or in a preferred embodiment polythene. The material may also be of a varying gauge. As shown in FIG. 1 the tube has a mouth end 2 and a tail end 6.

Advertising material, patterns, text and the like can be printed onto the side of the tube 1. Preferably the material of the tube and the print are such as to be able to withstand outside elements for a life-span of at least 5 to 6 weeks or longer as required.

The tube is attached to a fixing location or attachment means on the vehicle. For example, the fixing location may be an aerial, boat stay or similar structure. Also, by using several different types of fixing a wide variety of locations are possible. For example, windows, bicycle handlebars, frames, stays, wing mirror fittings, car roofs, bonnets and decking.

Figure 3:
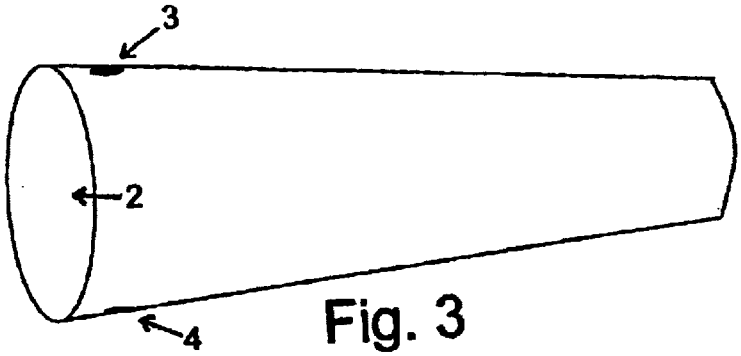
FIG. 3 shows a side view of an alternative display device tube.
Figure 6:
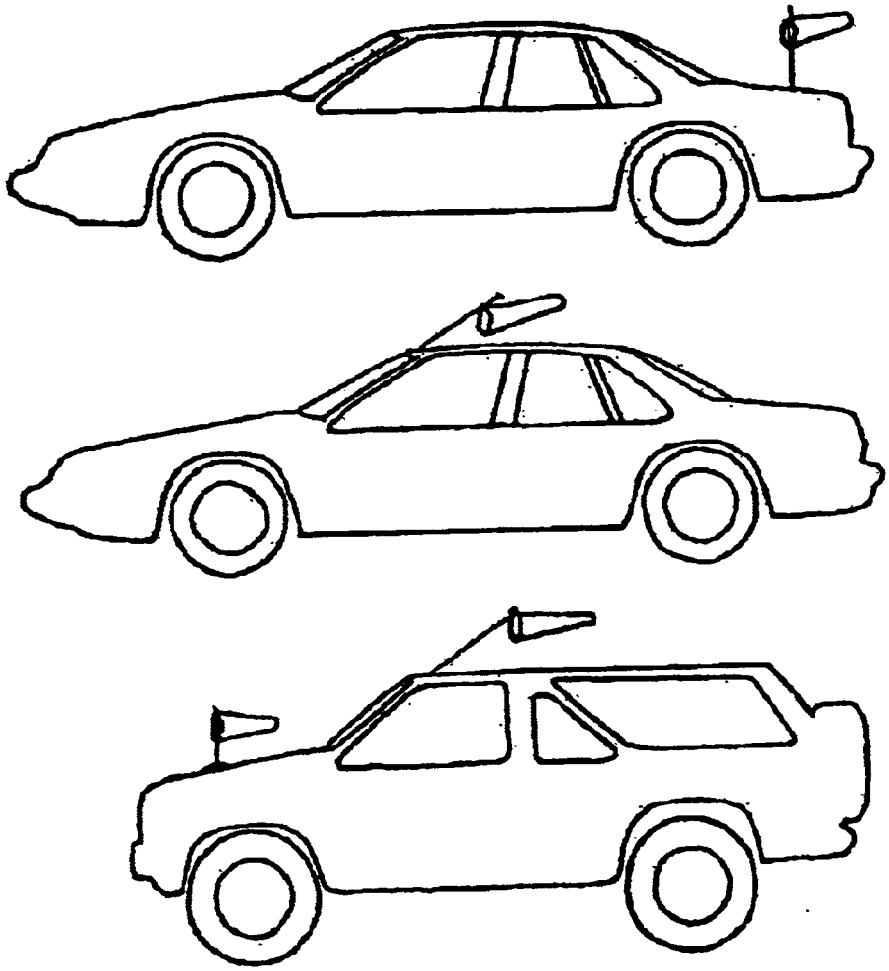
FIG. 6 shows display devices in use on car aerials.

A second fixing or attachment means is required to fix the tube onto the vehicle via the first attachment means. As will be appreciated from the following description, both these fixings can take a wide variety of forms. For example, the second fixing may consist of holes or slots, 3 and 4 (FIG. 3) positioned in the tube near the mouth 2. The display device can then be attached to an aerial, boat stay or other similar store by threading the aerial through both holes 3 and 4 or alternatively through only one of these holes as shown in FIG. 6. In the case where only one of the holes is used it is possible to only make one hole in the tube.

Figure 9:
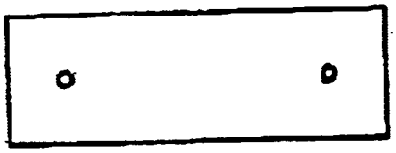
FIG. 9 shows a retaining strip for use with a display device.
Figure 10:
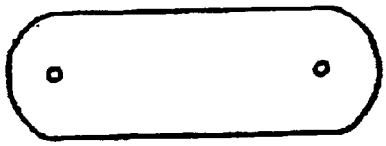
FIG. 10 shows an alternative retaining strip.
Figure 10A:
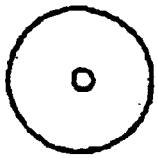
FIG. 10A shows another alternative retaining strip.
Figure 11:
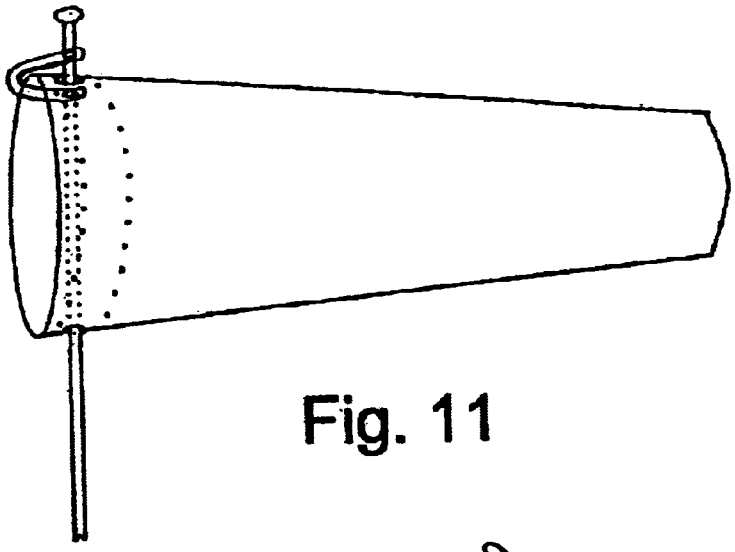
FIG. 11 shows standard Adsock mount for vertical/retractable aerials and aerials set at angles up to 45° fixing using rubber strap (FIG. 8) and retaining strip (FIGS. 9–10A)

In this example, the second attachment means comprises a resilient retaining strip adapted to connect the tube to the fixing location. In a preferred embodiment, the resilient retaining strip has at least two holes one at each end of the strip which are adapted to stretch over and locate with an aerial or similar structure. FIGS. 9 and 10 show examples of retaining strips. The retaining strip is placed onto the aerial or similar structure as shown in FIG. 11 and acts to hold the tube securely in place. The term resilient retaining strip also encompasses a plastic strap such as that shown in FIG. 28. FIG. 10A also shows another alternative retaining strip. This is in the form of a washer made from a resilient material such as highly elastic rubber that is adapted to stretch over and locate with an aerial or similar structure. It is possible to use either a single such washer type retaining strip or two or more of these pieces.

Figure 4:
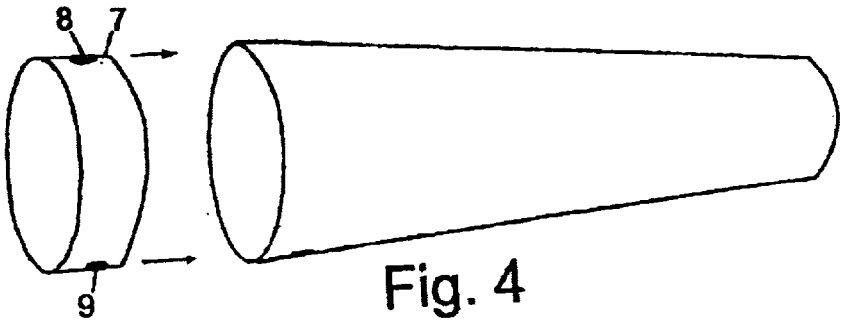
FIG. 4 shows a side view of a display device tube with a collar.

Considerable force is generated around the mouth of the tube when the vehicle moves at speed. A reinforced collar may also be provided substantially around the mouth of the tube. This may take the form of increased gauge material around the mouth of the tube. Alternatively, as shown in figure 4 a collar 7 can be placed around the mouth of the tube 1 as shown to provide extra strength and support in this region. This collar 7 may be placed either around the inside or the outside of the mouth. Holes or slots 8 and 9 are also provided in collar 7 so that they may be superimposed on the holes or slots 3 and 4 on the tube 1.

Alternative collars are shown in FIGS. 23, 24, 25, 36 and 37.

Figure 7:
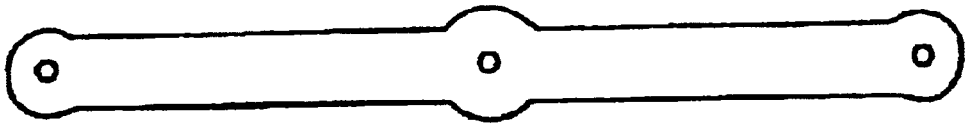
FIG. 7 shows a strap for use with a display device.
Figure 8:
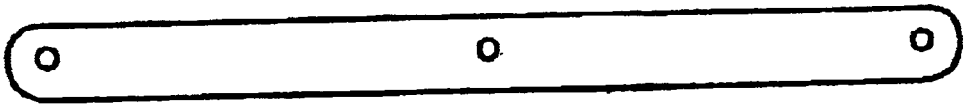
FIG. 8 shows an alternative strap for use with a display device.

A collar may also be provided by a strap such as those shown in FIGS. 7 and 8. These straps can be placed around the mouth of the tube and held in place using a channel such as that shown in FIG. 1.

Figure 12:
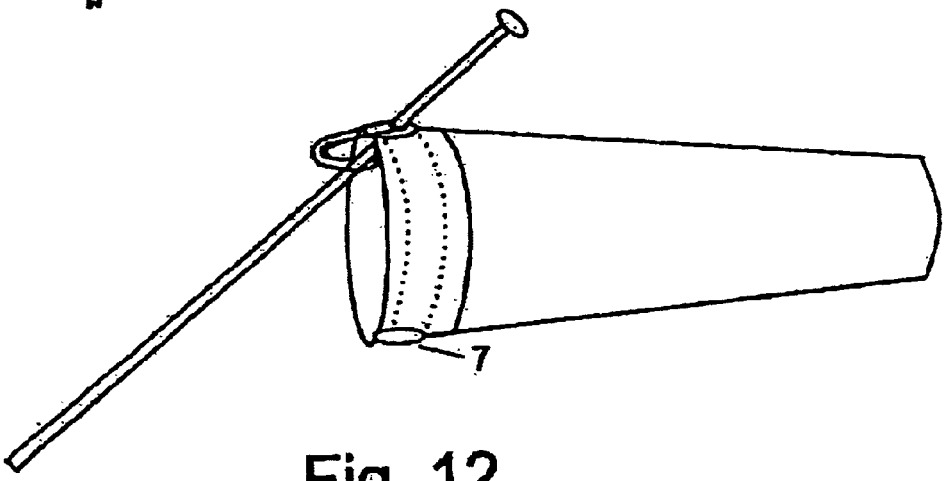
FIG. 12 shows standard Adsock mount for aerials set at angles less than 45° using rubber strap with additional rubber strip plus plastic rivet.
Figure 13:
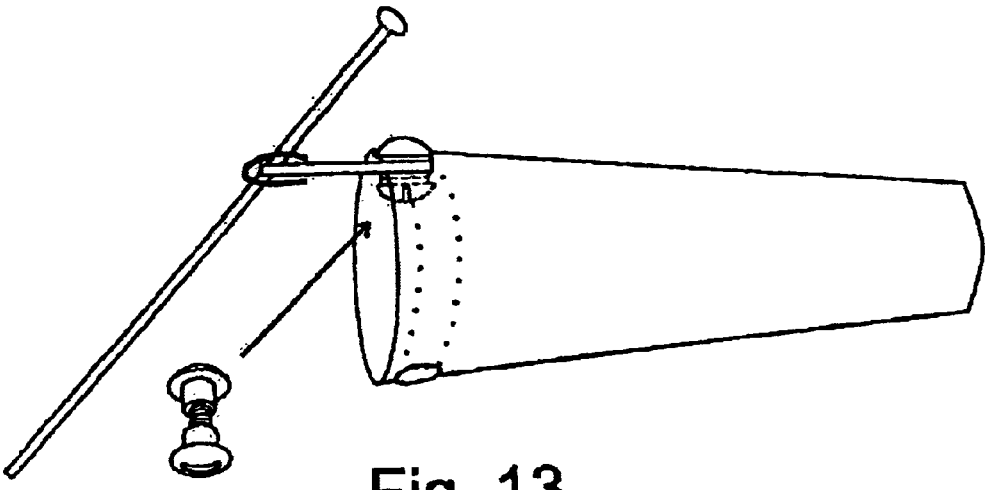
FIG. 13 shows alternative standard Adsock mount for aerials set at angles less than 45° using rubber strap with additional rubber strip plus plastic rivet and retaining strip.

In the cases where straps such as those shown in FIGS. 7 and 8 are used the tube is attached to the aerial or other similar structure using holes in the strap. As shown in FIGS. 7 and 8 three holes are positioned in the strap; one hole in the centre of the strap and one more at each end. The strap is of a length at least as long as the circumference of the mouth of the wind sock tube and is placed around the mouth as shown in FIGS. 11, 12 and 13.

As shown in FIG. 11 the aerial is threaded through the central hole in the strap and also through the holes at each end of the strap which superimpose. Alternatively, as shown in FIG. 12, the aerial is only threaded through the holes at each end of the strap. In this case it is possible to use a strap which has no central hole and, if the strap is held onto the tube using a channel as shown in FIG. 11 then the channel only needs one cut out region 3 (see FIG. 1).

In a preferred embodiment the channel is formed by folding back the material at the mouth of the tube 2 to provide a channel 5. The material can be attached to the rest of the tube by any conventional means, for example by stitching, heat sealing or gluing.

Figure 2:
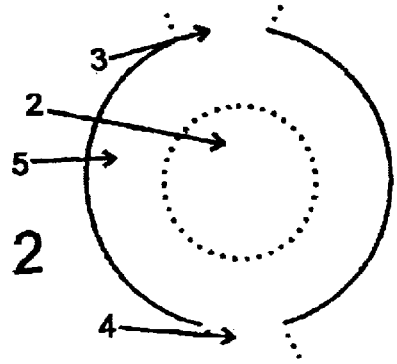
FIG. 2 shows a front view of a display device tube.
Figure 29:
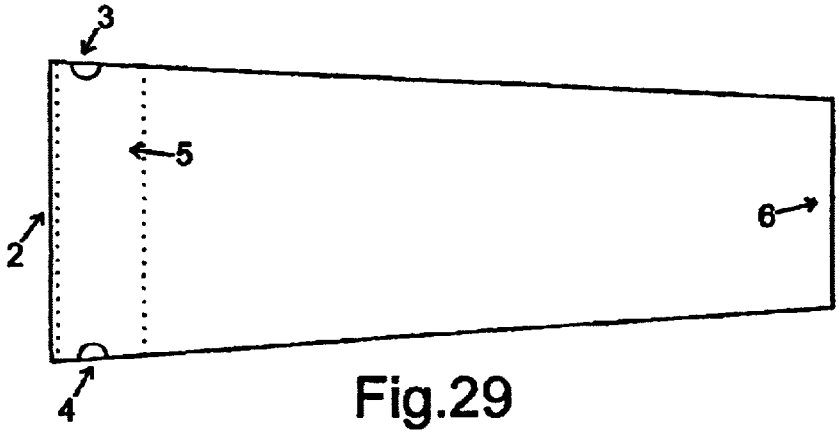
FIG. 29 shows a side view of a display device tube with alternative holes.

At least one and preferably two holes or slots 3 and 4 are provided in the channel in order that the strap can be inserted into the channel and that the holes in the strap are exposed. The holes or slots 3 and 4 are diametrically opposed about the mouth, of the tube as shown in FIGS. 1 and 2. The holes or slots 3 and 4 may be rectangular or square cut outs as shown in FIG. 1 or alternatively may simply be an angled or curved edge. FIG. 29 shows an alternative type of hole 3, 4 which enable a continuous rim at the mouth of the display device tube to be retained.

In a particularly preferred embodiment the reinforcement takes the form of an adhesive strip 32 formed from any suitable plastics material. Such a strip is shown in FIGS. 36 and 37, FIG. 37 showing typical dimensions. The strips incorporate strategically placed holes 30 which allow for either aerial/pole mounting or for a 3 point mounting using the tri-mounting struts illustrated in FIGS. 38, 39 or 40 (see below).

The holes 30 may incorporate radial slits 31 to facilitate insertion of an aerial tip which is otherwise broader in diameter than the hole itself. The strip 32 may contain adhesive on one side suitable for adhesion onto the tube material. Any suitable adhesive may be used as suggested by the materials specialist.

It is also possible to provide any of these different kinds of collar at the tail end of the tube to increase the flying characteristics of the display device.

Figure 20:
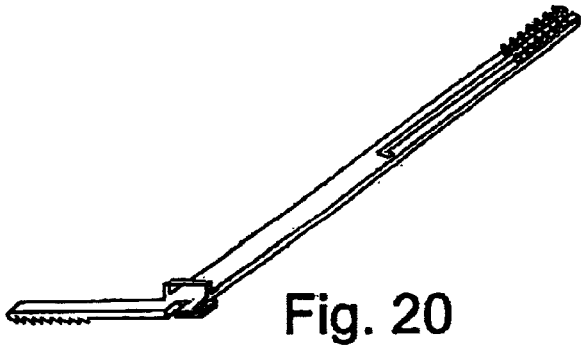
FIGS. 20 and 21, show two-way polythene "ratchet fasten fixing" strap (alternative fixing all Adsocks)
Figure 21:
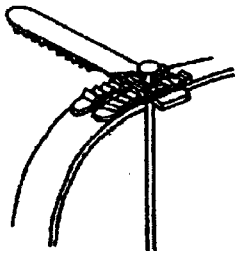
Figure 22:
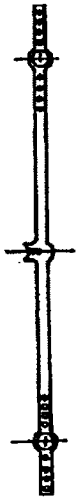
FIG. 22, shows plastic snap-fitting strap (alternative fixing all Adsocks)

In alternative embodiments straps such as those shown in FIGS. 20, 21, 22 can be used.

As already mentioned by, using several different types of fixing a wide variety of fixing locations are possible. For example, windows and bicycle handlebars. Several of these different types of fixing are illustrated in FIGS. 14 to 18 and FIGS. 30 to 32.

Figure 26:
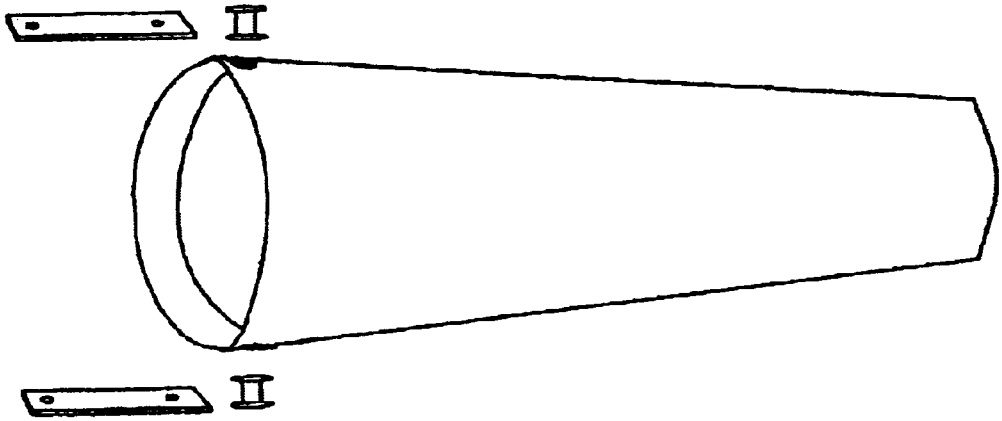
FIG. 26 shows alternative standard fixing mount using standard rubber strap plus two additional rubber strips plus two plastic rivets (all aerials up to 45° inclination)

FIG. 26 shows an alternative attachment means which includes a stud for use together with a retaining strip. A pair of studs and retaining strips can be used as shown in FIG. 26 or alternatively, only one stud and strip. This alternative attachment means can be used with any type of collar.

Figure 19:
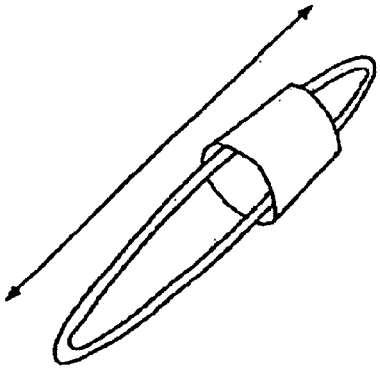
FIG. 19 shows elastic retaining band with or without collar (alternative retaining strip)

FIG. 19 shows another embodiment of the retaining strip. As shown this is a small rubber band fitted with a sliding toggle. It can be used as a retaining strip as follows:

- Slide the toggle to the centre to allow a loop either side of the toggle.
- Put one loop over the end of the aerial.
- Use the toggle to slide towards the aerial and tighten the loop against it.
- Then the top aperture in the display device tube or in the retaining strap is placed over the top of the aerial and on top of the first loop.
- The second loop of the elastic band is taken and fastened over the top of the display device tube or retaining strap and also over the display device collar if necessary onto the top of the aerial. Twists can be made in the band in order to reduce any slack if necessary.

Figure 28:
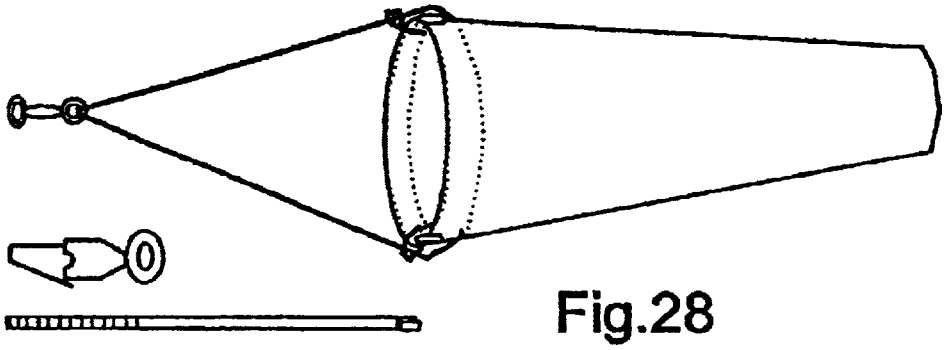
FIG. 28 shows alternative Adsock mount for any aerial fixing—standard rubber strap fixing, plus string and swivel fixing, with plastic retaining strap.

FIG. 28 shows use of a swivel with the display device. Two alternative types swivel are shown in this figure. In order to fix the swivel to an aerial the following steps are followed:

- Pass one end of the plastic strap through the hole in one end of the swivel.
- Offer the plastic strap to the aerial, encircle the aerial, passing the tapered end of the plastic strap through its plastic fastener and drawing tight, thus affixing the swivel to the aerial with the plastic strap.
- The other end of the swivel is then attached to the tie strings of the windsock.

The shape of the tube is important for proper and efficient operation. As well as the conical shape, or more strictly frusto-conical shape, described above and novelty shapes described below other shapes are possible. In order that the tube can remain inflated at relatively low speeds the diameter at the mouth region should be greater than the diameter at the tail region.

The word "diameter" would tend to suggest a substantially circular cross-section. However, this is not necessarily the case and square, rectangular and elliptical cross-sections are all acceptable. What is preferred, however, is that there should be a restriction in airflow along the tube between the mouth end and the tail end and preferably near the tail end. In principle, any form of restriction will suffice from a taper to the overall shape to an internal restriction of some sort.

Figure 33:
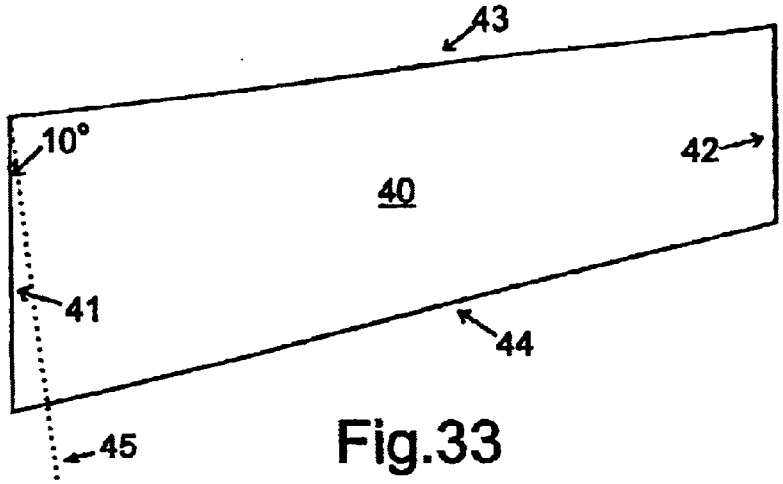
FIGS. 33 to 35 inclusive show alternative profiles for an inflatable tube with typical dimensions.
Figure 34:
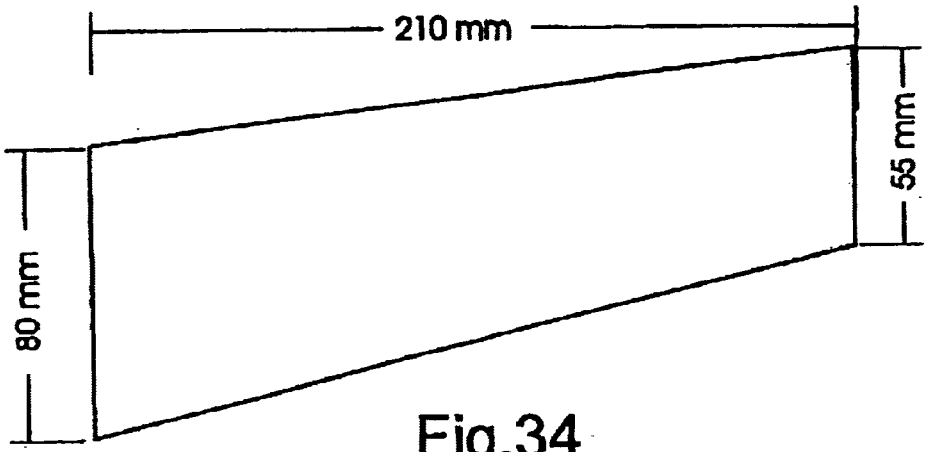
Figure 35:
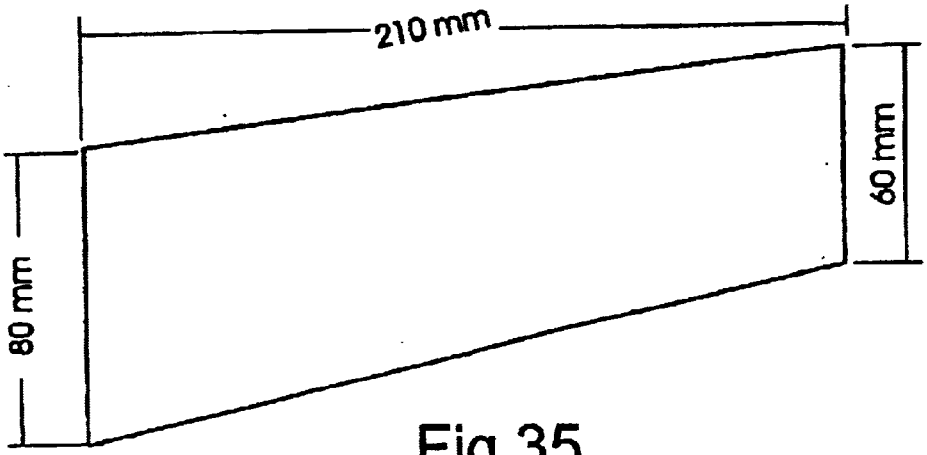

A preferred profile for a tapered shape is shown in FIGS. 33, 34 and 35. These illustrate flattened profiles of various tubes, some with typical dimensions given. Referring to FIG. 33, this illustrates a tube 40 with a mouth 41, a tail end 42 and upper and lower edges 43 and 44 respectively. The plane of the mouth region 41 is angled at approximately 10° with respect to the perpendicular 45 struck from the upper edge 43.

This arrangement encourages the display device to extend out substantially horizontally from the first fixing point even when the vehicle is moving at speed. More specifically, it allows for any rearwards flexing that might take place in the pole, post, aerial or other fixing that the display device may be fixed to.

The display device can also be made from material which has a finish such as a fluorescent or luminous finish. Reflective materials or reflective coatings and the like can also be used.

Display device adaptations include:

An illuminated version of the display device is possible. This can be achieved for example by placing a light bulb inside the display device and providing power for this bulb from a small battery source or from the car/vehicle cigarette socket or other power source.

An auditory version of the display device. This can be achieved by inclusion of a whistle or howler or other such noise-making device into the display device. For example, the noise-making device can be driven by air-currents and can be added to the tail end of the display device tube.

Figure 30:
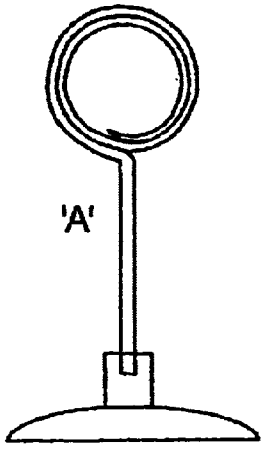
FIG. 30 shows an aerial with a spiral shaped end for use with a display device.
Figure 31:
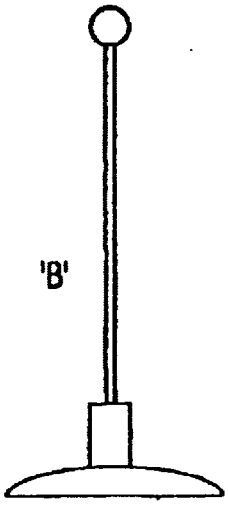
FIG. 31 shows an aerial for standard display device fitting (with retaining strip)
Figure 32:
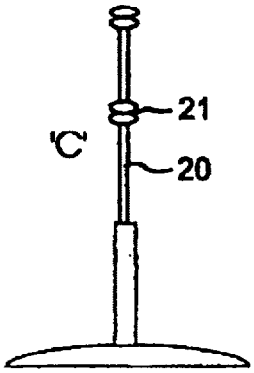
FIG. 32 shows an aerial for use with a standard display device (without a retaining strip)

FIGS. 30 to 32 show alternative posts or pseudo aerials for used with window/clamp bracket fittings and rubber suction fittings. FIG. 30 shows an alternative method of fixing the display device which is to thread the collar of the display device tube around the spiral end of a pseudo aerial that is formed with a spiral end as shown. This holds the mouth of the display device tube open and no strap is needed.

The stop 21 on the mounting shaft 20 in FIG. 32 is important because it provides a barrier to the bottom of the tube mouth rising too far up the post when the vehicle travels at speed.

The three pronged connectors 50, 60, 70 shown in FIGS. 38, 39 and 40 act as fastening means to fasten a tube to an aerial top or its equivalent. Referring to FIG. 38, spaced holes are provided in the reinforced collar of the tube and the individual ends 51, 52, 53 are threaded through separate holes. The end regions catch and secure in much the same way that a modern price tag is secured to a garment with a plastic strip. The aerial point or equivalent is then inserted through hole 54 to install the display device in place.

Connectors working on a similar principle are shown in FIGS. 39 and 40.

Figure 41A:
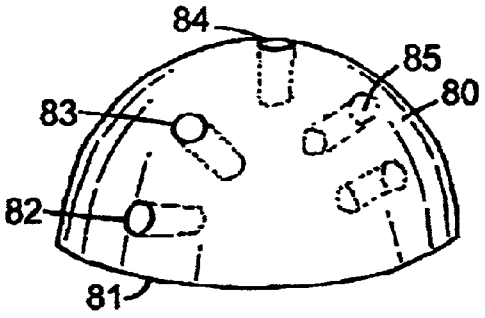
FIGS. 41 to 43 inclusive illustrate two forms of mounting block suitable for mounting onto a vehicle to accommodate a short post as illustrated in FIGS. 21 and 32.
Figure 41B:
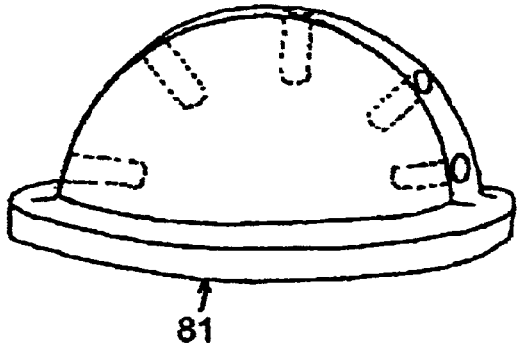
Figure 42:
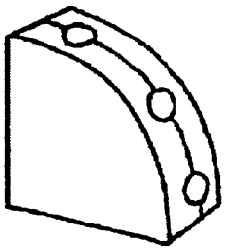
Figure 43:
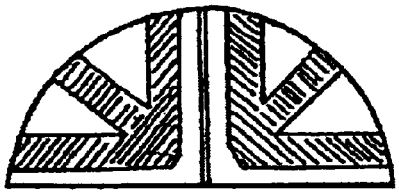

In certain circumstances, it is preferred to mount the display device on a windscreen or other window of a vehicle. Mounting units suitable for this purpose are illustrated in FIGS. 41, 42 and 43. FIG. 41 illustrates a semi-circular block 80 with a self-adhesive base 81 and various mounting holes 82–85 set at different angles. Adhesive which will stick firmly to glass is well known. Once mounted, a short post is fitted into one of the holes as a first attachment means and a display tube attached to it by any of the means described above.

FIGS. 42 and 43 show a hinged version of a smaller but similar device.

Figure 44:
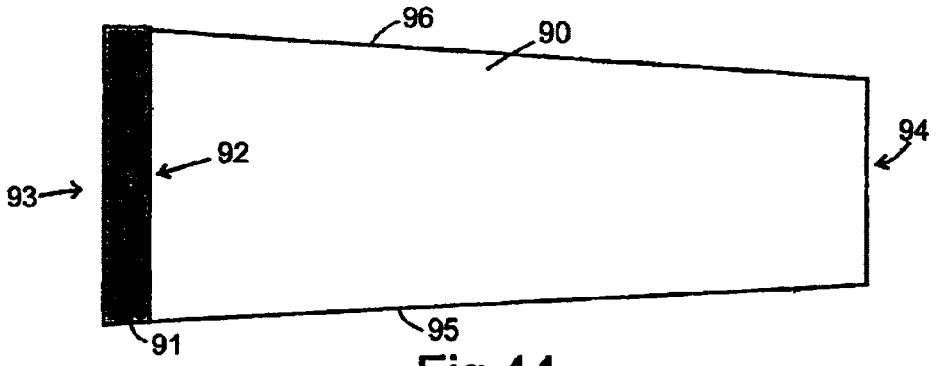
FIGS. 44 and 45 illustrate in side elevation a frusto-conical tube folded flat and with typical dimensions shown in FIG. 45.

FIG. 44 illustrates a generally frusto-conical shaped tube 91 with a larger diameter mouth end 93 and a smaller diameter tall end 94. It is made from a thin but strong plastics material such as polyethylene, polypropylene or nylon. Around the mouth is a reinforced collar region 91 formed from a tough adhesive tape. Holes 92 are cut through the centre of the collar region in the mid point of the tube and diagonally opposite each other. The tube is illustrated folded flat and this is advantageous both for ease of shipping and for ease of construction. This flat or collapsed formal can be achieved by forming seams in the tube along lines 95 and 96 and by forming creases in the collar region along the same lines. As a result of this form of construction the tube naturally seeks to adopt a collapsed or flat configuration unless constrained otherwise. The collar region is still flexible so even when assembled, see below, the tube may be pressed flat in either the plane shown in FIG. 44 or some other plane.

Figure 45:
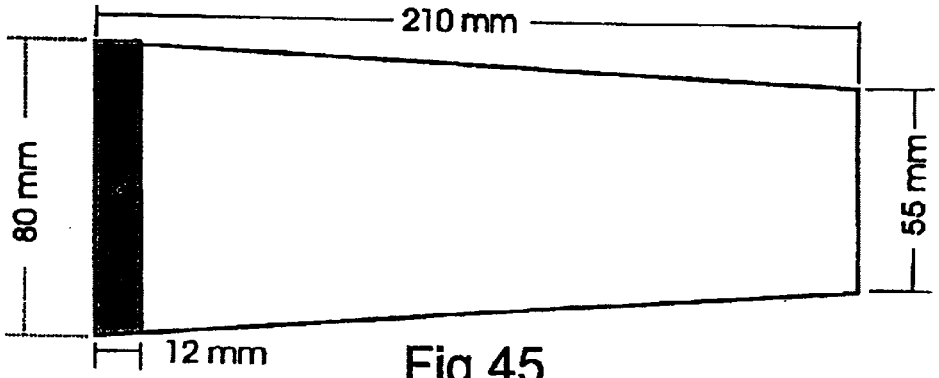
Figure 46:
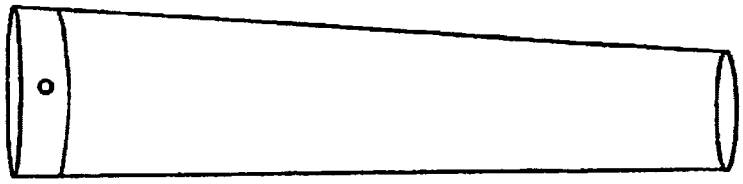
FIGS. 46 and 47 illustrate in side elevation the tubes from FIGS. 44 and 45 held in an open or inflated configuration.
Figure 47:
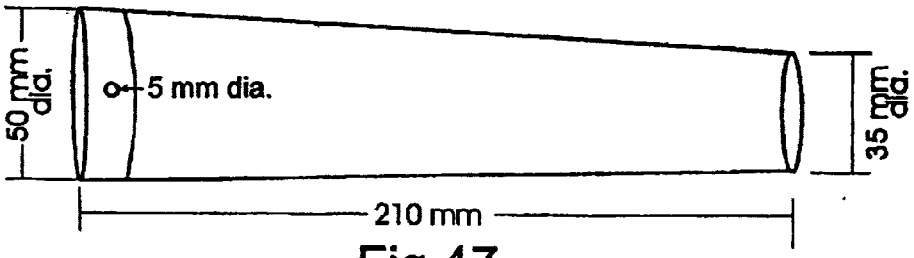

FIGS. 45 and 47 illustrate some typical dimensions in millimeters. The relative dimensions of circumference/diameter of the larger and smaller openings and the tube length are critical to producing a tube which will remain stable in flight at typical vehicle speeds ie 5 mph to 85 mph. Some minor departure from these relative proportions is however possible. A variation of 10% for example may be possible but experiments have shown that variations of more than 20% give rise to products that are not stable at normal speeds.

Thus a typical aspect ratio of the diameter of the larger opening to the diameter of the smaller opening is 1.05 to 2.4. A more suitable aspect ratio of these two dimensions is 1.4±0.3. A particularly preferred ratio is 1.4±0.1.

Similarly, a preferred ratio of tube length to large diameter to small diameter is 210±10 to 50±5 to 35±4. A particularly preferred ratio is 210:50:35.

Figure 48:
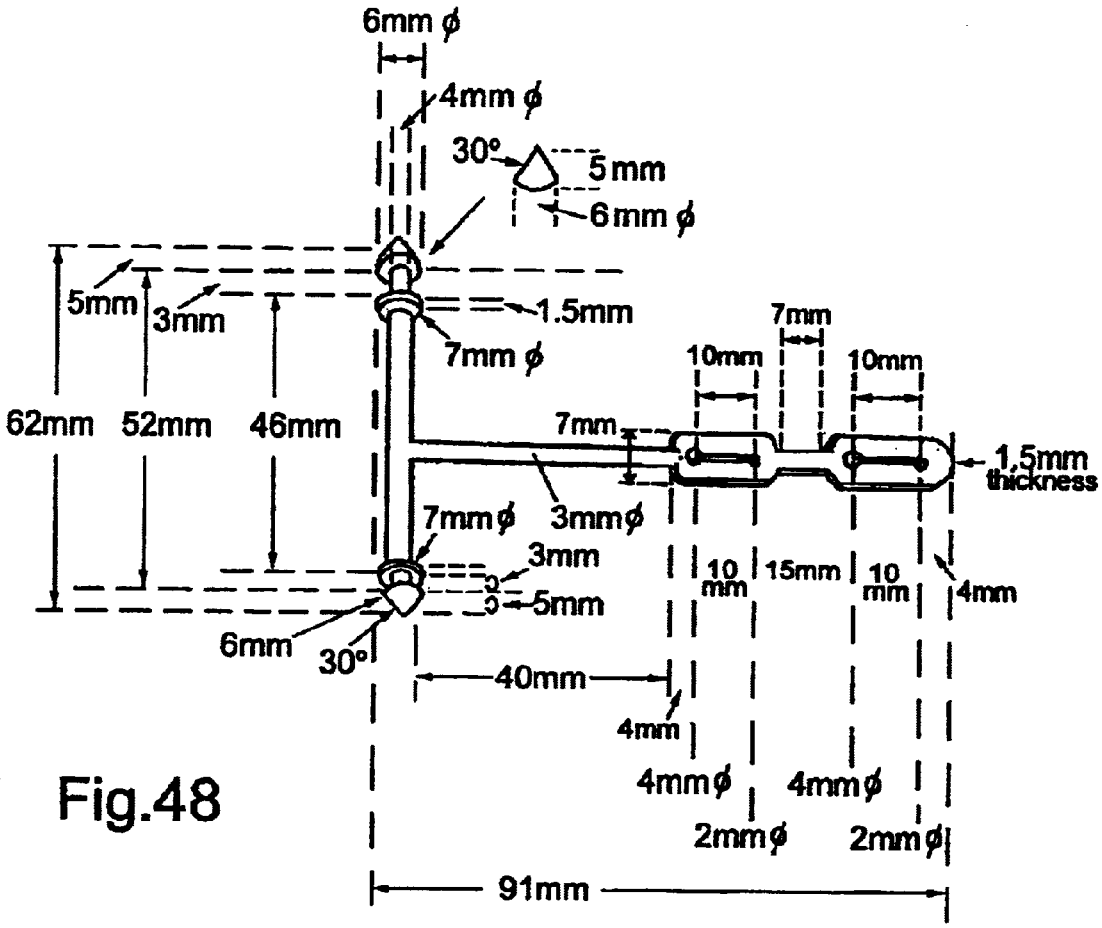
FIGS. 48 and 49 illustrate a T-shaped attachment means with typical dimensions shown in FIG. 48.
Figure 49:
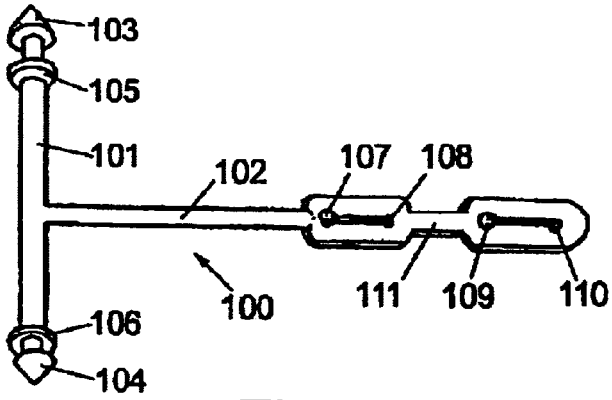

A particularly preferred mounting means is illustrated in FIG. 49, with typical dimensions given in FIG. 48 for a tube of the dimensions given in FIGS. 45 and 47. The attachment means 100 is substantially T-shaped, being formed from a cross-member 101 and a fixing bar 102. At opposite ends of the cross member are located lugs 103, 104 which are designed to pass through holes 92 in the reinforced collar. In this example the lugs are pointed to facilitate passing the lugs through the holes because they are a tight passing fit.

A short distance behind each lug is a stop 105, 106 designed to stop the tube passing further along the cross member. The tube material is therefore held restrained between the rear face of the lug and the adjacent stop.

The fixing bar is attached to the cross member at one end and at the other is flattened into two small plates.

Each plate contains two holes 107, 108 and 109, 110 connect by a slit. The two plates are connected by a flexible neck region 111. By bending the neck region back on itself such that the two plates are superimposed one over the other, the fixing bar can be threaded over an aerial or pseudo aerial. The slits are large enough for any enlarged tip on the aerial to pass through.

The attachment means is preferably formed from soft, pliable plastics material and may also be resilient. It is also substantially flat such that the whole display device can be shipped flat packed. This is ideal for including in a magazine, brochure or in an envelope.

Once assembled, the cross member of the attachment means tends to hold the mouth of the tube open slightly since the seam in the tube and the fold in the collar region reinforcement prevent it collapsing naturally about its horizontal axis. However, the tube is flexible enough that it can be collapsed about the horizontal axis if need be.

Unlike prior art display devices the mounting points are on the mid point of the sides of the tube such that the cross member spans the horizontal axis across the tube when it is in use mounted on an aerial. This arrangement increases the stability, resilience and flight characteristics of the display device over earlier versions.

Further examples of display devices according to the invention are described below where the trade mark ADSOCK is used to refer to the display device.

1. Introduction

The Adsock has been developed for use with a motor vehicle aerial and pseudo aerials affixed to bicycles, motorcycles and vehicle handlebars, wing mirror stays and fixings, boat pushpits/pulpits/stays and vehicle windows.

The Adsock, as the name suggests, will carry a promotional message, company logo and/or signifying colours of a product or service. The main purpose is to attract the attention of passers by and form a novel way of communicating any message be it branding/supporting or informative.

2. Identifying Characteristics

The identifying characteristics of the Adsock are:

2.1 The flight/wind-catching ability (due to the unique fixing and of being located on any vehicle) giving it an instant recognition by being inflated using the vehicle's motion, rather than the natural element of the wind as a windsock. The essential requirement is that the mouth and tail of the Adsock is held open with commencement of vehicular motion. This is achieved with the addition of a collar at the mouth and/or the tall to increase the circular appearance of the mouth/tail aperture. This can also be achieved by increasing the gauge of material used at either or both these points.

2.2 The design and material of construction being polythene and/or polythene derivatives necessitates particular flanges, holes and dimensions (see FIGS. 1 to 4).

Figure 5:
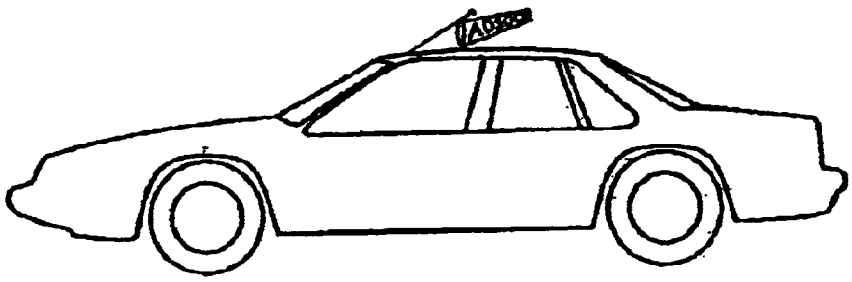
FIG. 5 shows a display device in use on a vehicle.

2.3 The colour and individual message ring facility—i.e. allowing printing and being highly visible (see FIGS. 5 and 6—showing colour/message carrying ability).

2.4 The Adsock requires motion to inflate it; this necessitates a requirement for a versatile and unique fixing method to attach it to suitable positions/locations on vehicles/boats, to include:

2.4.1 Aerial/pseudo aerial (vertical/angled, static and retractable)

2.4.2 Window (top of window fixing to facilitate horizontal or vertical flight)

2.4.3 Standard size tubular fixing—e.g. handlebar 2.4.4 Variable diameter tubular fixing—e.g. frames, stays and wing mirror fittings 2.4.5 Flat surface fixing—e.g. roof, decking, etc. NB: Please refer to Methodology for detail.

2.5 The materials of construction, for both the Adsock and the fixing giving rise to low cost production methodology to allow promotional usage.

3. Fixing Methodology 3.1 Straps, Brackets and Clamps

The unique application of the Adsock to be used with any moving vehicle gives rise to individually designed fixing straps to cater for the varying fixing locations to be found on vehicles. Below are listed the standard fittings to cover all vehicle aerials followed by a list of alternative fittings to cover all vehicle aerials followed by a list of alternative fittings that can be utilised to achieve the same end.

3.1.1 Standard Rubber Strap (all Adsocks)

To be inserted into the collar provided on the Adsock. The central hole in the rubber strap is then eased over the nipple end of the aerial followed by one end of the retaining strip (listed below) using hole provided. Then ease over the remaining two ends of the rubber strap (using holes provided). Finally, fix in position by easing the remaining end of the retaining strip (using hole provided) over the nipple end of the aerial (see FIGS. 7 and 8).

3.1.2 Standard Rubber Retaining Strip (all Adsocks)—see explanation above (see FIGS. 9 and 10).

3.1.3 Vertical static/retractable aerials/pseudo aerials/masts—Standard fixing using rubber strap and retaining strip (all aerials up to 45° inclination) (see FIG. 11).

3.1.4 Angled aerials/roof aerials (static and retractable) <45°—Standard fixing using rubber strap with additional rubber strip plus plastic rivet and retaining rubber strip (see FIGS. 12 and 13).

Figure 14:
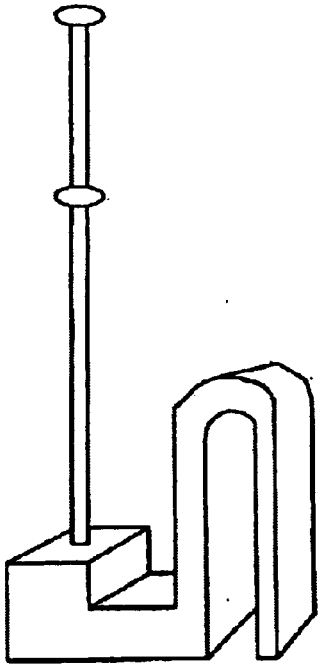
FIG. 14 shows top of window slotted mount fixing bracket plus pseudo aerial—vertical.
Figure 15:
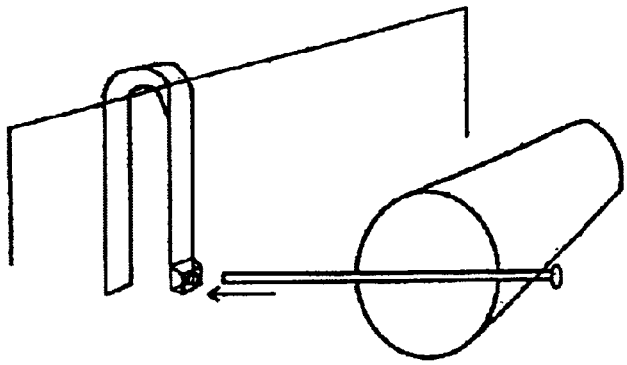
FIG. 15 shows top of window slotted mount fixing bracket plus pseudo aerial—horizontal.

3.1.5 Window fixings—slotted mount for top of window fixing with vertical or horizontal additional pseudo aerial/mast (see FIGS. 14 and 15).

Figure 16:
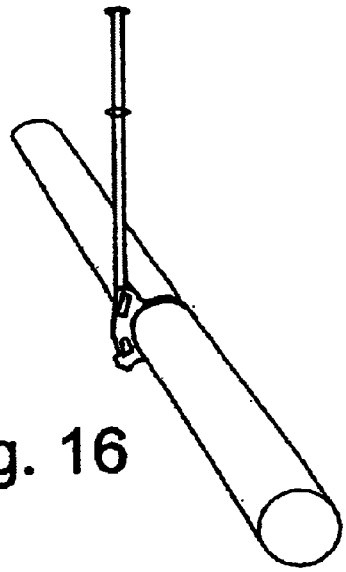
FIG. 16 shows handlebar and standard size tubular mount ratchet clamp (hose clamp) fitting for standard size tubular flying plus pseudo aerial.

3.1.6 Bicycle/motorcycle—handlebars and standard size tubular frame parts—ratchet claim (hose clamp) for a tubular fixing with additional pseudo aerial/mast (see FIG. 16).

Figure 17:
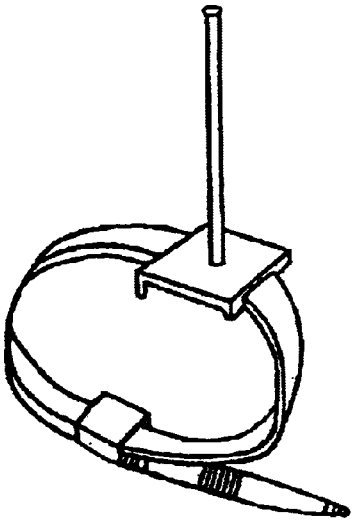
FIG. 17 shows plastic ratchet strap with saddle for non-standard size tubular fixing.

3.1.7 Additional tubular fixings for boats and vehicles—plastic ratchet strap with saddle for non-standard size tubular fixing (see FIG. 17).

Figure 18:
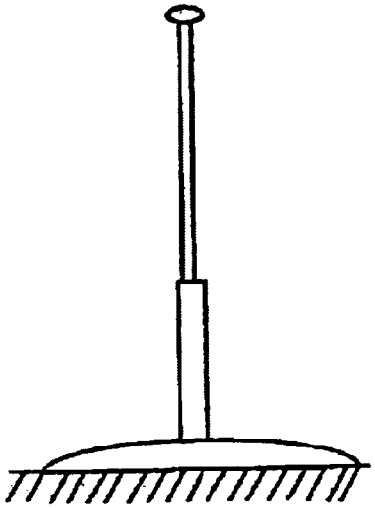
FIG. 18 shows rubber suction cup for flat surface fixing plus pseudo aerial.

3.1.8 Flat surface fixing—rubber suction cup for flat surface fixing (see FIG. 18).

3.2 Alternative Adsock Fixing Straps/Collars

Elastic retaining band with or without collar (alternative retaining strip) (see FIG. 19).

Plastic strap—two-way polythene ratchet fixing (alternative fixing all Adsocks) (see FIGS. 20 and 21).

Plastic snap-fitting strap (alternative fixing all Adsocks) (see FIG. 22).

Figure 24:
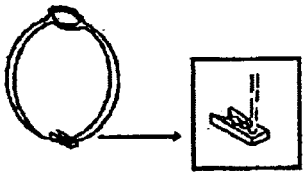
FIG. 24 shows plastic collar with snap fitting (alternative fixing all Adsocks)

Plastic collar with snap fitting (alternative fixing all Adsocks) (see FIG. 24).

Figure 23:
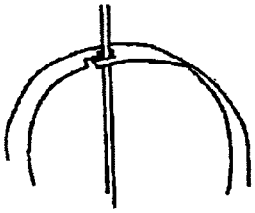
FIG. 23 shows plastic collar with slot fitting (alternative fixing all Adsocks)

Plastic collar with slot fitting (alternative fixing all Adsocks) (see FIG. 23).

Figure 25:
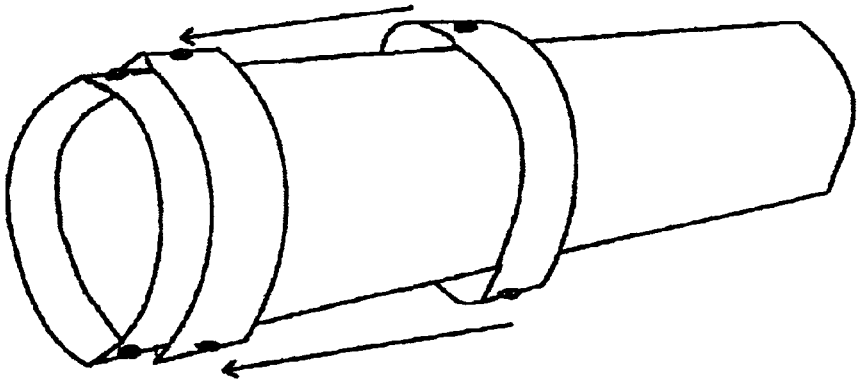
FIG. 25 shows clamp fitting with two concentric flexible rings.

Clamp fitting with two concentric flexible rings (see FIG. 25).

3.3 Alternative Adsock Fixings

Alternative fixing mount using standard rubber strap plus two additional rubber strips (all aerials up to 45° inclination) (see FIG. 26).

Figure 27:
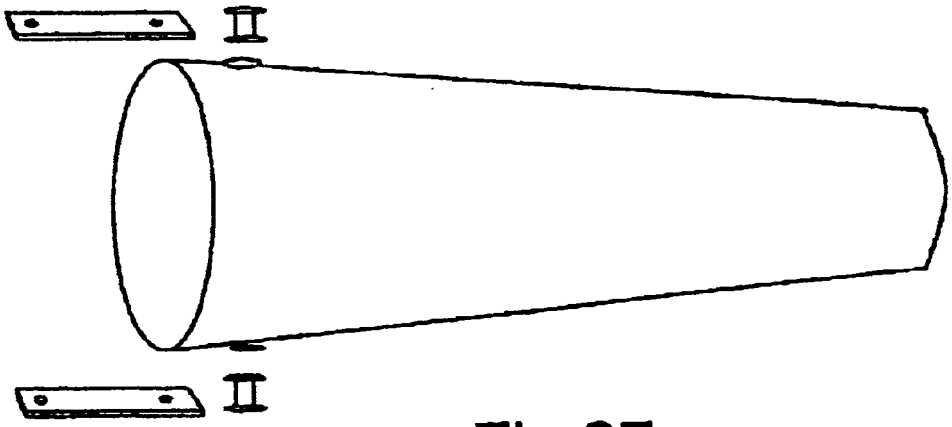
FIG. 27 shows alternative fixing using varigauge material (with higher gauge at mouth) with two retaining holes plus two additional rubber strips and plastic rivets (all aerials up to 45° inclination)

Alternative fixing using varigauge material (with higher gauge at mouth) with two retaining holes plus two additional rubber strips and plastic rivets (all aerials up to 45° inclination) (see FIG. 27).

Alternative fixing using varigauge material (with higher gauge at mouth) with two retaining holes plus one additional rubber strip and plastic rivet (all aerials less than 45° inclination) (see FIG. 27).

Alternative Adsock mount for any aerial fixing—standard rubber strap fixing, plus string and swivel tied on, with plastic retaining (see FIG. 28).

Detailed drawings of all the above are shown in Appendix C.

4. Material Specifications for Polythene/Rubber/Plastic Brackets/Straps & Adsocks 4.1 Standard Adsock manufacture in polythene c20 micron low-density uniform thickness. Other gauges and densities to be used according to application. Higher specification models to be manufactured in other materials to include fine cottons, nylon and kite materials—e.g. Kevlar.

5. Shaped Versions Other than Conical that Can Inflate Whilst Vehicle is in Motion Novel shapes e.g. Tube—parallel dimensions Fish Bottle Globe Box Shirt Shorts Tasselled versions

What is claimed is:

1. In a vehicle of the type having an upstanding aerial or pseudo aerial, the improvement comprising a display device, said display device comprising:

(i) a flexible, inflatable tube with a mouth end and a tail end, said mouth end being movable between a normally flat collapsed state and a substantially open inflated state:

(ii) a reinforced flexible collar region extending around substantially the whole circumference of the mouth end of the tube, the collar region being adapted such that the mouth end of the tube tends to adopt a flat collapsed state, the mouth end incorporating at least on a fixing hole in the reinforced flexible collar region; and (iii) attachment means to attach the reinforced collar region of the inflatable tube to the vehicle aerial or pseudo aerial, said attachment means comprising a cross-member and a fixing bar, the ends of the cross member being adapted to engage with the reinforced collar region of the inflatable tube and hold the mouth end of the tube in the open state, and the fixing bar being adapted to attach to the vehicle aerial or pseudo aerial, the cross member being non-rotationally linked to the fixing bar.

2. A windsock display device as claimed in claim 1 wherein the reinforced flexible collar region is formed from a strip of plastics materials fixed around the mouth end of the tube.

3. A display device according to claim 1 wherein the reinforced collar region comprises a region of the tube of increased material thickness compare to the main body of the tube.

4. A display device as claimed in claim 1 wherein the reinforced collar region comprises a tubular channel extending substantially around the circumference of the mouth end of the tube, said channel incorporating a reinforcing strip.

5. A display device as claimed in claim 1 wherein the reinforced flexible collar region incorporates two fixing holes, diametrically opposed one to the other.

6. A display device as claimed in claim 1 wherein the means to attach the collar region of the tube to a vehicle aerial or pseudo aerial is formed from a pliable resilient plastics material.

7. A display device according to claim 1 wherein the attachment means is a substantially T-shaped assembly formed from the cross member and the fixing bar, the cross member incorporating a lug at each end of the cross member, said lugs being adapted to pass through respective holes in the reinforced flexible collar, said cross member further incorporating a stop, adjacent each lug, said stops being located inwardly of the lugs to prevent the sides of the tube passing along the cross member, and resisting the natural tendency of the tube to adopt a flat collapsed state.

8. A display device according to claim 1 wherein the flexible tube is frusto-conical in shape, having an opening at each end.

9. A display device according to claim 1 wherein the flexible tube is frusto-conical in shape having an aspect ratio of the diameter of the large opening to the diameter of the small opening in the range 1.05 to 2.4.

10. A display device according to claim 1 wherein the flexible tube is frusto-conical in shape having an aspect ratio of the diameter of the large opening to the diameter of the small opening in the range 1.4±0.3.

11. A display device according to claim 1 wherein the flexible tube is frustoconical in shape having a ratio of the length of the tube to the diameter of the large opening to the diameter of the small opening of 210±40 to 50±10 to 35±5.

12. A display device according to claim 1 wherein the flexible tube is frusto-conical in shape having a ratio of the length of the tube to the diameter of the large opening to the diameter of the small opening of 210±10 to 50±5 to 35±4.

* * * * *